US010648757B2

(12) United States Patent
Wheeler

(10) Patent No.: US 10,648,757 B2
(45) Date of Patent: May 12, 2020

(54) FIREARM MUZZLE DEVICE ATTACHMENT FACILITY

(71) Applicant: WM C Anderson INC, Hebron, KY (US)

(72) Inventor: David Edmon Wheeler, Florence, KY (US)

(73) Assignee: WM C ANDERSON INC, Hebron, KY (US)

( * ) Notice: Subject to any disclaimer, the term of this patent is extended or adjusted under 35 U.S.C. 154(b) by 0 days.

(21) Appl. No.: 16/216,876

(22) Filed: Dec. 11, 2018

(65) Prior Publication Data

US 2020/0025498 A1 Jan. 23, 2020

Related U.S. Application Data

(60) Provisional application No. 62/619,856, filed on Jan. 21, 2018, provisional application No. 62/619,757, filed on Jan. 20, 2018, provisional application No. 62/619,441, filed on Jan. 19, 2018.

(51) Int. Cl.
*F41A 21/32* (2006.01)

(52) U.S. Cl.
CPC ..... *F41A 21/325* (2013.01)

(58) Field of Classification Search
CPC ..... F41A 21/30; F41A 21/32; F41A 21/325; F41A 21/34; F41A 21/36
USPC ..... 89/14.2, 14.3, 14.4, 14.05
See application file for complete search history.

(56) References Cited

U.S. PATENT DOCUMENTS 2,341,680 A * 2/1944 Williams ..... F41A 5/26 89/193
2,462,119 A * 2/1949 Moore ..... F41A 5/28 89/193
4,893,426 A * 1/1990 Bixler ..... F16B 7/20 403/299
5,271,312 A * 12/1993 Lishness ..... F41A 21/484 42/76.01
5,945,626 A * 8/1999 Robbins ..... F41A 5/26 42/111
7,353,740 B1 * 4/2008 Hoffman ..... F41A 21/26 42/107
7,832,326 B1 * 11/2010 Barrett ..... F41A 5/18 42/95

(Continued)

*Primary Examiner* — Jonathan C Weber
(74) *Attorney, Agent, or Firm* — Bennet K. Langlotz; Langlotz Patent & Trademark Works, LLC

(57) ABSTRACT

Firearms have an alignment element configured to connect to the barrel with the threaded muzzle portion exposed forward of the alignment element, the alignment element having a lock element movable between a release position and an engaged position, a muzzle device having internal threads configured to mate with the threaded portion of the barrel, the muzzle device defining a lock channel adapted to receive the lock element in the engaged position, the lock channel including wall portions configured to contact the lock element in the engaged position to prevent rotation of the muzzle device, and the lock element in the release position being clear of the lock channel to enable the muzzle device to rotate for removal from the threaded muzzle portion. The alignment element may define a first bore portion configured to closely receive a selected barrel portion immediately aft of the shoulder surface.

20 Claims, 9 Drawing Sheets

(56) References Cited

U.S. PATENT DOCUMENTS

| | | | | |
|---|---|---|---|---|
| 7,891,284 | B1 * | 2/2011 | Barrett | F41A 5/28 89/14.4 |
| 8,091,462 | B2 * | 1/2012 | Dueck | F41A 21/26 89/14.05 |
| 8,201,487 | B2 * | 6/2012 | Dueck | F41A 21/26 89/14.05 |
| 8,763,510 | B2 * | 7/2014 | Dueck | F41A 21/26 89/14.4 |
| 8,978,286 | B2 * | 3/2015 | Schafer | F41A 21/40 42/79 |
| 9,261,318 | B2 * | 2/2016 | Wood, Jr. | F41A 21/325 |
| 9,964,376 | B2 * | 5/2018 | Odle | F41A 21/325 |
| 2006/0060076 | A1 * | 3/2006 | Dueck | F41A 21/30 89/14.4 |
| 2011/0023699 | A1 * | 2/2011 | Barrett | F41A 5/28 89/193 |
| 2012/0167756 | A1 * | 7/2012 | Larue | F41A 5/28 89/193 |
| 2014/0096426 | A1 * | 4/2014 | Schafer | F41A 21/40 42/79 |
| 2015/0135575 | A1 * | 5/2015 | Wood, Jr. | F41A 21/325 42/90 |
| 2017/0184367 | A1 * | 6/2017 | Odle | F41A 21/325 |
| 2019/0170461 | A1 * | 6/2019 | Leitner-Wise | F41A 5/28 |

* cited by examiner

FIREARM MUZZLE DEVICE ATTACHMENT FACILITY

CROSS-REFERENCE TO RELATED APPLICATION

This application claims the benefit of U.S. Provisional Patent Application No. 62/619,441 filed on Jan. 19, 2018, entitled "AMD (Advanced Muzzle Device) System, AR-15/10 and M16/M4 Variants and Others," claims the benefit of U.S. Provisional Patent Application No. 62/619,757 filed on Jan. 20, 2018, entitled "HT (Hold Tite) Gas Block System, AR-15/10 and M16/M4 Variants and Others," and claims the benefit of U.S. Provisional Patent Application No. 62/619,856 filed on Jan. 21, 2018, entitled "QL (Quad-Lok) Hand Guard System, AR-15/10 and M16/M4 Variants and Others," which are hereby incorporated by reference in its entirety for all that is taught and disclosed therein.

FIELD OF THE INVENTION

The present invention relates to firearms, and more particularly to firearm having an orientation element that releasably secures a muzzle device to the firearm in a specified orientation without requiring the use of tools or a single-use crush washer. The firearm also includes a gas block with orienting features that ensures accurate orientation and positioning of the gas block on the firearm's barrel. The firearm also includes a floating handguard that can be repeatably secured to the firearm in a specified orientation to eliminate the need to recalibrate a sighting device attached to the handguard if the handguard is removed and reattached.

BACKGROUND OF THE INVENTION

The modern AR-15 style rifle platform is primarily comprised of MIL-SPEC (Military Specification) components, originally derived from the M16A1/A2, M4A1 and M16A4 variants. Platforms include semi-automatic, burst and full-automatic fire control versions, as well as a multitude of caliber configurations. Most modern AR-15 components have retained either MIL-SPEC adherence and/or a close resemblance thereof to the original 1956 Eugene Stoner and L. James Sullivan Armalite AR-15 design. All M16A1/A2, M4A1 and M16A4 variants retain absolute adherence to MIL-SPEC requirements, as these platforms are intended for applications in standardized military service. Nevertheless, since the original inception of the AR-15, M16/M4 variants, there remains an impractical design flaw which continues to be incorporated into every revision, improvement or reconfiguration of these platforms.

This flaw consists of an externally threaded barrel that requires a single-use crush washer to captivate and orient a muzzle device (e.g. flash hider, muzzle brake, compensator, suppressor, etc.). Installation and/or removal of a muzzle device requires the use of a wrench, and each new installation requires a new crush washer, in accordance with single use (MIL-SPEC) limitation. This design inherently impairs simple removal and/or replacement of muzzle devices. Furthermore, upon installation, the muzzle device must be accurately oriented and/or positioned to properly enable the flash hider pattern or provide correct recoil compensation direction. The muzzle device installer must rely solely on visual orientation during installation. If the device is tightened past an intended position, or requires reorientation, retarding the muzzle device away from a previous washer crush or collapse could render the crush washer unserviceable, as previous tension would be lost. Additionally, use of a crush washer may require cutting the washer from the barrel upon removal, as the crush action oftentimes deforms the washer around the threaded barrel, lower than the maximum thread diameter of the barrel, thus further impeding removal. Cosmetic damage to the barrel's finish can result because use of a tool to cut off the used crush washer is frequently required. Thus, it would be highly desirable to eliminate the need for a crush washer and a wrench to install a muzzle device on a firearm.

The aforementioned MIL-SPEC design utilizes a direct gas impingement system, which is comprised of a front sight base assembly that mitigates the redirection of ballistic gas pressure from barrel porting by means of a gas tube delivery to the BCG (Bolt Carrier Group to complete the direct gas impingement system cycle. The front sight base assembly also provides captivation of the gas tube and handguard cap, as well as integrated locations for the front sight post mechanism, bayonet lug, and sling swivel ring. Captivation of the front sight base to the barrel assembly is provided through two tapered pins that orientate and secure the front sight base to the barrel.

AR-style platforms that deviate from the original MIL-SPEC front sight base design must employ a gas block device to supplement the removal of the original front sight base. This gas block replacement is typically configured to slide onto the outer diameter of the barrel and over the barrel gas porting hole. Barrels are typically produced with a shouldered step diameter that is greater than that of the gas block inner diameter, to serve as a positioning stop. Once positioned up to this stop, the gas block is visually aligned on the barrel to ensure the gas tube, which is pinned to the gas block upon assembly, seats into the receiving face of the upper receiver. This orientation process is problematic because the gas tube may be slightly misaligned, permitting interference with the gas key on the BCG, thus allowing undesired friction and/or drag of the components. Likewise, and possibly more consequential, would be the compromised leaking of ballistic gas pressure between the gas tube and gas key, thus reducing the effectiveness of the direct gas impingement system cycle.

Affixing the gas block to the barrel within current industry standards is also problematic in that set screws are commonly used for this function. Considering set screws are limited to lateral pressure in one direction, their application creates a high probability of set screw force negating proper concentricity of gas block and barrel alignment. As such, a compromised seal between the gas block and barrel is often created, which negatively impacts the effectiveness of the direct gas impingement system cycle. Small set screws, typically ¼" and smaller, are commonly used in gas block installations and are prone to overtightening, seizing, and stripping of the drive profile. It is not uncommon that seized or damaged set screws may require the gas block to be cut from the barrel to remove the gas block, which requires gas block replacement and can potentially damage the barrel. Furthermore, tightening the set screw onto the radial surface of the barrel can also negatively impact gas block alignment as the screws tightening rotational direction on the radial surface can cause the gas block to twist upon installation. After a gas block has been tightened to a barrel in a misaligned position, the gas block will often repeat the misalignment when attempts are made to re-orient it because the barrel has usually been scored by the previous set screw tightening and orientation attempt.

One common approach to reduce gas block twist or misalignment during installation is to provide a flat surface, pocket depression(s), or dimple(s) on the barrel's outer diameter for set screw nesting. However, the overtightening, seizing and/or stripping of the set screw drive profile remains a problematic condition, as does the unfavorable conditions regarding gas block distorting and subsequent ballistic gas pressure compromise. As there exists no standardized pattern or set screw spacing within the firearms industry, barrel alterations regarding pocket depressions or dimples may cause mismatched conditions, including inappropriate positioning on commercially available, non-standardized gas blocks.

Additionally, misaligned gas blocks can also prevent appropriate handguard installation because internal profiles of handguards tend to be limited in space and require a close and parallel and/or perpendicular alignment with the gas block. When a gas block's orientation prohibits handguard installation, the gas block must be reoriented, further compounding the previously stated detrimental conditions.

Finally, the current industry standard for gas block captivation can provide less than adequate mechanical holding force when hardware (i.e. set screws) has been compromised. This condition is further exacerbated when the gas block is exposed to ballistic gas pressures outside original MIL-SPEC design parameters. Gas block movement and subsequent loss of operating gas pressure commonly occurs under these circumstances.

The aforementioned MIL-SPEC design utilizes an integrated handguard assembly, also referred to as a forearm, which is generally replaced on rifle platforms that deviate from the original MIL-SPEC design. Most prevalent replacement handguard styles employ a float design (commonly referred to as a free float handguard) in which the only point of contact between the firearm and the handguard is at the barrel nut that secures the barrel to the upper receiver. Most designs employ an extended barrel nut that secures the barrel to the upper receiver, thus serving as a mounting base for the handguard. Handguard ends are commonly slotted and supplied with several clamping screws that apply clamping pressure around the barrel nut with a slotted clamp force to captivate the handguard around the barrel nut. The slotted clamp force design is problematic because clamping forces are not applied concentrically around the barrel nut's base, thus distorting and often seizing the handguard around the barrel nut, which impedes removal or adjustment. This condition also negatively alters handguard to barrel alignment. The extended design of the barrel nut also adds additional weight to the firearm.

Another type of handguard captivation utilizes a sleeved-coupling system that employs a threaded locking ring to secure the handguard body to a barrel nut. A primary shortcoming of this design entails the alignment of the barrel nut to a proper orientation in relationship to the upper receiver gas tube port. Overtightening often occurs when attempting proper alignment, or a shim may be required to time thread engagement with port alignment. This design commonly requires a special tool, such as a spanner wrench, to install or remove the handguard; which further complicates installation, removal, or adjustment of the handguard.

An additional mounting design exists that utilizes a laterally bolted system, which is mounted upon a handguard base, which then is mounted to the upper receiver. While this design offers more consistent and evenly dispersed clamping force, the design does not address handguard alignment and permits misaligned handguard installation. When a handguard is misaligned, it is often difficult to access the driving profile of the hardware to secure the handguard.

With any conventional handguard design, the inability to repeatably ensure a specified alignment creates further complications when an optical aid or sighting device (e.g. flip-up sight post, laser sight, etc.) is mounted to the handguard. When the handguard cannot be repeatably removed and reattached to a firearm in a specified alignment, sighting devices must be recalibrated or zeroed once a handguard installation has been compromised or altered. While many prior art handguard mounting designs exist, including other variations not specifically discussed, existing handguard designs do not ensure rigid application, repeatable installation, control of proper alignment, and ease of use.

Therefore, a need exists for a new and improved firearm having an orientation element that releasably secures a muzzle device to the firearm in a specified orientation without requiring the use of tools or a single-use crush washer. A need also exists for a firearm having a gas block with orienting features that ensures accurate orientation and positioning of the gas block on the firearm's barrel. A need also exists for a firearm having a floating handguard that can be repeatably secured to the firearm in a specified orientation to eliminate the need to recalibrate a sighting device attached to the handguard if the handguard is removed and reattached. In this regard, the various embodiments of the present invention substantially fulfill at least some of these needs. In this respect, the firearm according to the present invention substantially departs from the conventional concepts and designs of the prior art, and in doing so provides an apparatus primarily developed for the purpose of having an orientation element that releasably secures a muzzle device to the firearm in a specified orientation without requiring the use of tools or a single-use crush washer. The apparatus has also been developed for the purpose of providing a gas block with orienting features that ensures accurate orientation and positioning of the gas block on the firearm's barrel. The apparatus has also been developed for the purpose of providing a floating handguard that can be repeatably secured to the firearm in a specified orientation to eliminate the need to recalibrate a sighting device attached to the handguard if the handguard is removed and reattached.

SUMMARY OF THE INVENTION

The present invention provides an improved firearm, and overcomes the above-mentioned disadvantages and drawbacks of the prior art. As such, the general purpose of the present invention, which will be described subsequently in greater detail, is to provide an improved firearm that has all the advantages of the prior art mentioned above.

To attain this, the preferred embodiment of the present invention essentially comprises an alignment element configured to connect to the barrel with the threaded muzzle portion exposed forward of the alignment element, the alignment element having a lock element movable between a release position and an engaged position, a muzzle device having internal threads configured to mate with the threaded portion of the barrel, the muzzle device defining a lock channel adapted to receive the lock element in the engaged position, the lock channel including wall portions configured to contact the lock element in the engaged position to prevent rotation of the muzzle device, and the lock element in the release position being clear of the lock channel to enable the muzzle device to rotate for removal from the threaded muzzle portion. The alignment element may define a first bore portion configured to closely receive a selected barrel portion immediately aft of the shoulder surface. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
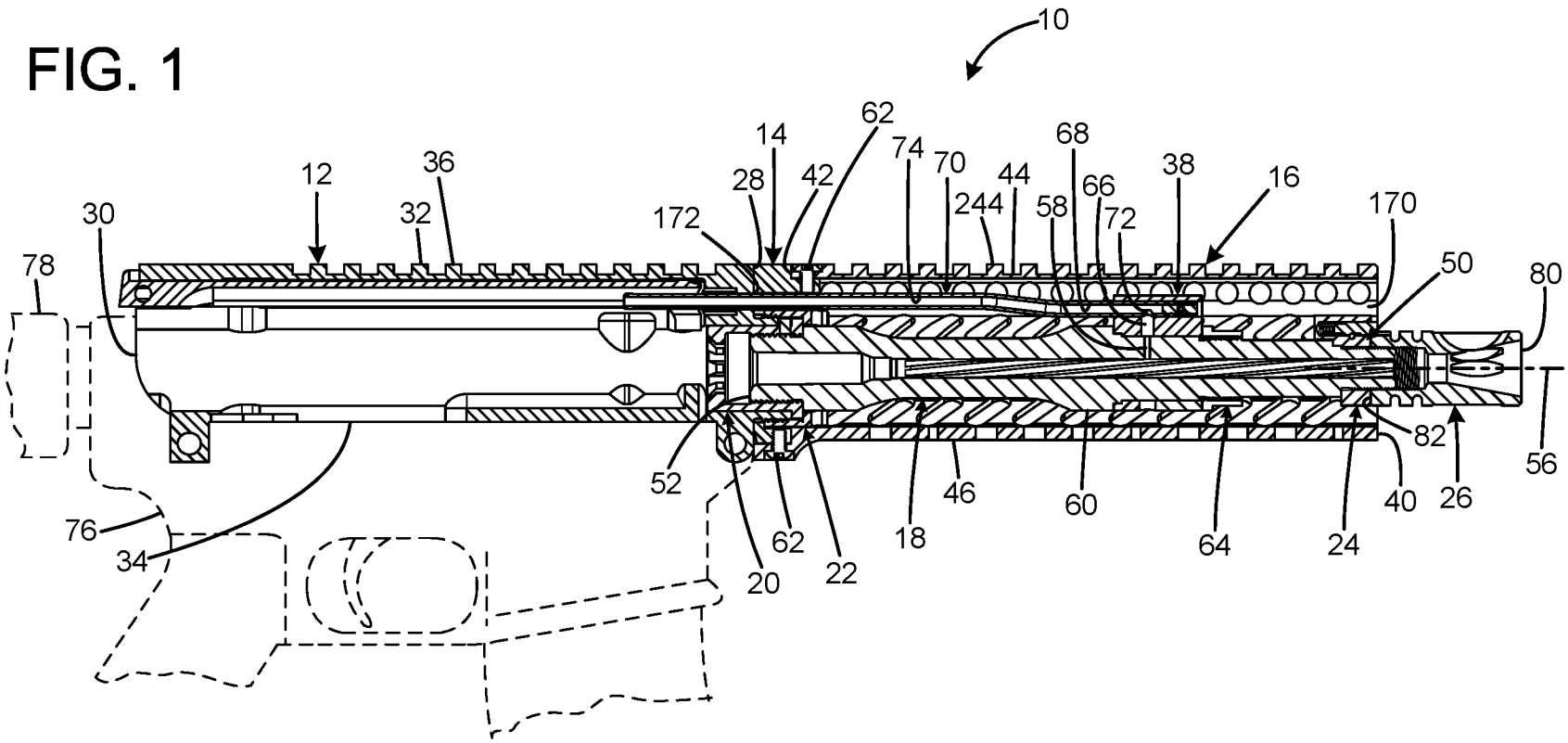
FIG. 1 is a side sectional view of the current embodiment of the firearm constructed in accordance with the principles of the present invention.

A current embodiment of the rifle scope with zero lock of the present invention is shown and generally designated by the reference numeral 10.

FIG. 1 illustrates the improved firearm 10 of the present invention. More particularly, the firearm has an upper receiver 12, a base coupling 14, a handguard 16, a barrel 18, a barrel extension 20, a barrel nut 22, an orientation/alignment element 24, a muzzle device 26, and a gas block 38. The upper receiver has a front 28, rear 30, top 32, and bottom 34. The top of the receiver includes a Picatinny rail 36. The handguard has a front 40, rear 42, top 44, and bottom 46. The top of the handguard includes a Picatinny rail 244. The handguard defines a longitudinal central bore 48. The barrel has a front muzzle 50, rear 52, and has a longitudinal central bore 54 that defines a barrel axis 56. A gas port 58 that is perpendicular to the barrel axis provides communication between the central bore of the barrel and an exterior surface 60. The barrel extension is threadedly connected to the rear of the barrel. The barrel and barrel extension are releasably connected to the front of the upper receiver by the barrel nut. The base coupling is clamped between the front of the upper receiver and the rear of the handguard. The rear of the handguard is secured to the barrel nut by four screws 62. The gas block is releasably secured to the exterior of the barrel by a gas block nut 64. The gas block defines a gas passage 66 that communicates between the gas port and a gas tube bore 68. A gas tube 70 has a bottom aperture 72 that communicates with the gas passage. The gas tube defines a central bore 74 that enables gas that has escaped from the central bore of the barrel through the gas port and gas passage to travel rearward into the upper receiver to cycle the action (the action is not shown). The firearm also includes a lower receiver 76 that is attached to the bottom of the upper receiver and a stock 78 that is attached to the rear of the upper receiver. The muzzle device has a front 80 and a rear 82. The rear of the muzzle device is threadedly attached to the muzzle of the barrel. The muzzle device is maintained in a specified orientation by the orientation element, which encircles the muzzle. Each of these elements will be described in more detail subsequently.

Figure 2:
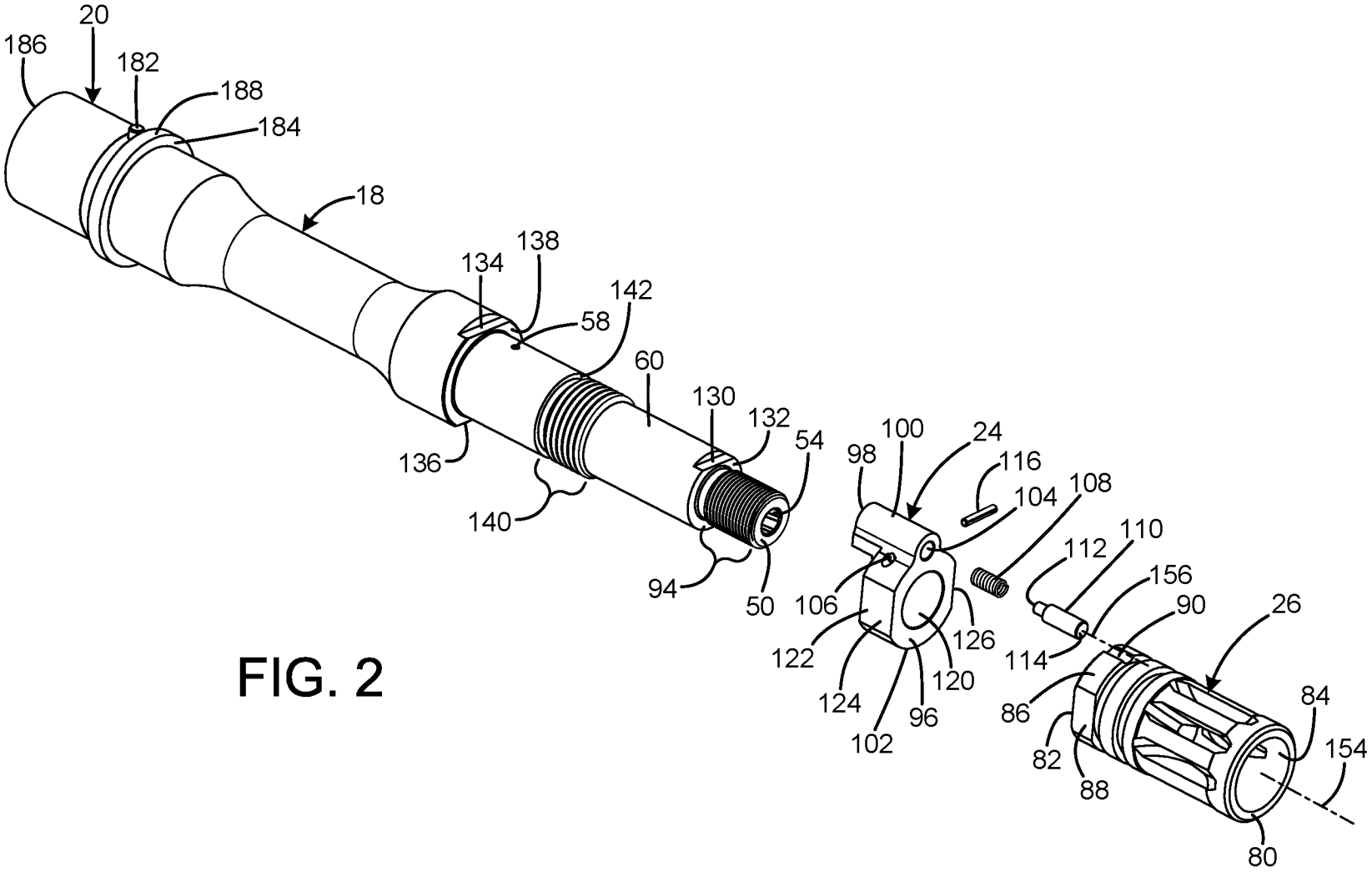
FIG. 2 is an exploded view of the current embodiment of the barrel, orientation element, and muzzle device of FIG. 1.
Figure 3:
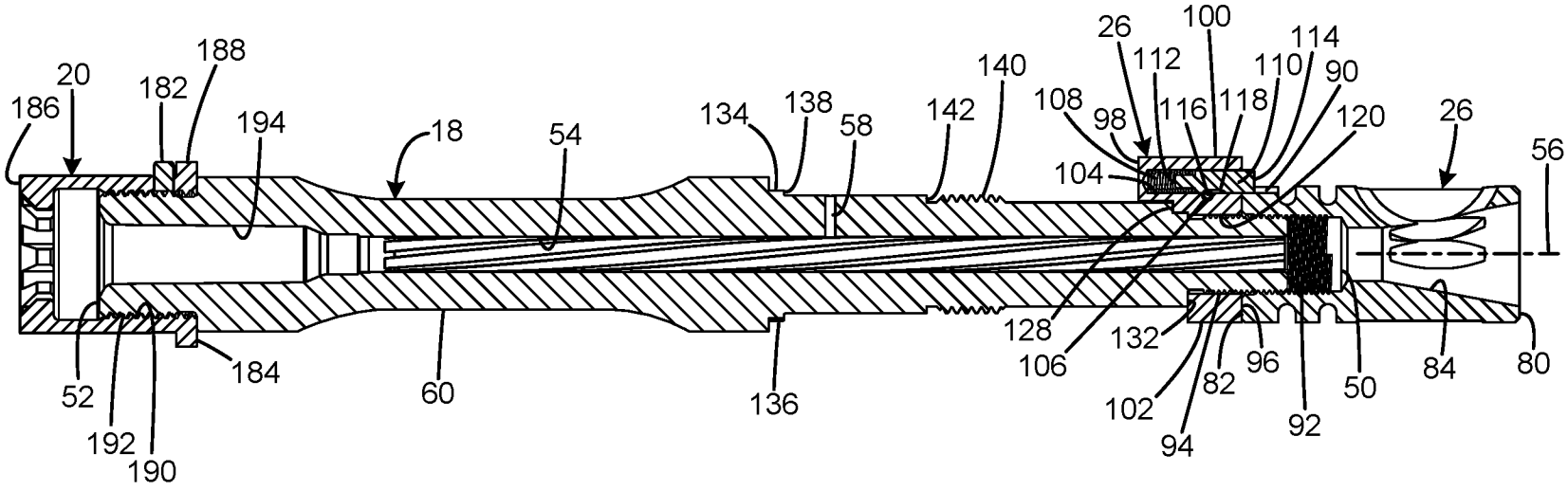
FIG. 3 is a side sectional view of the current embodiment of the barrel, orientation element, and muzzle device of FIG. 1.
Figure 4:
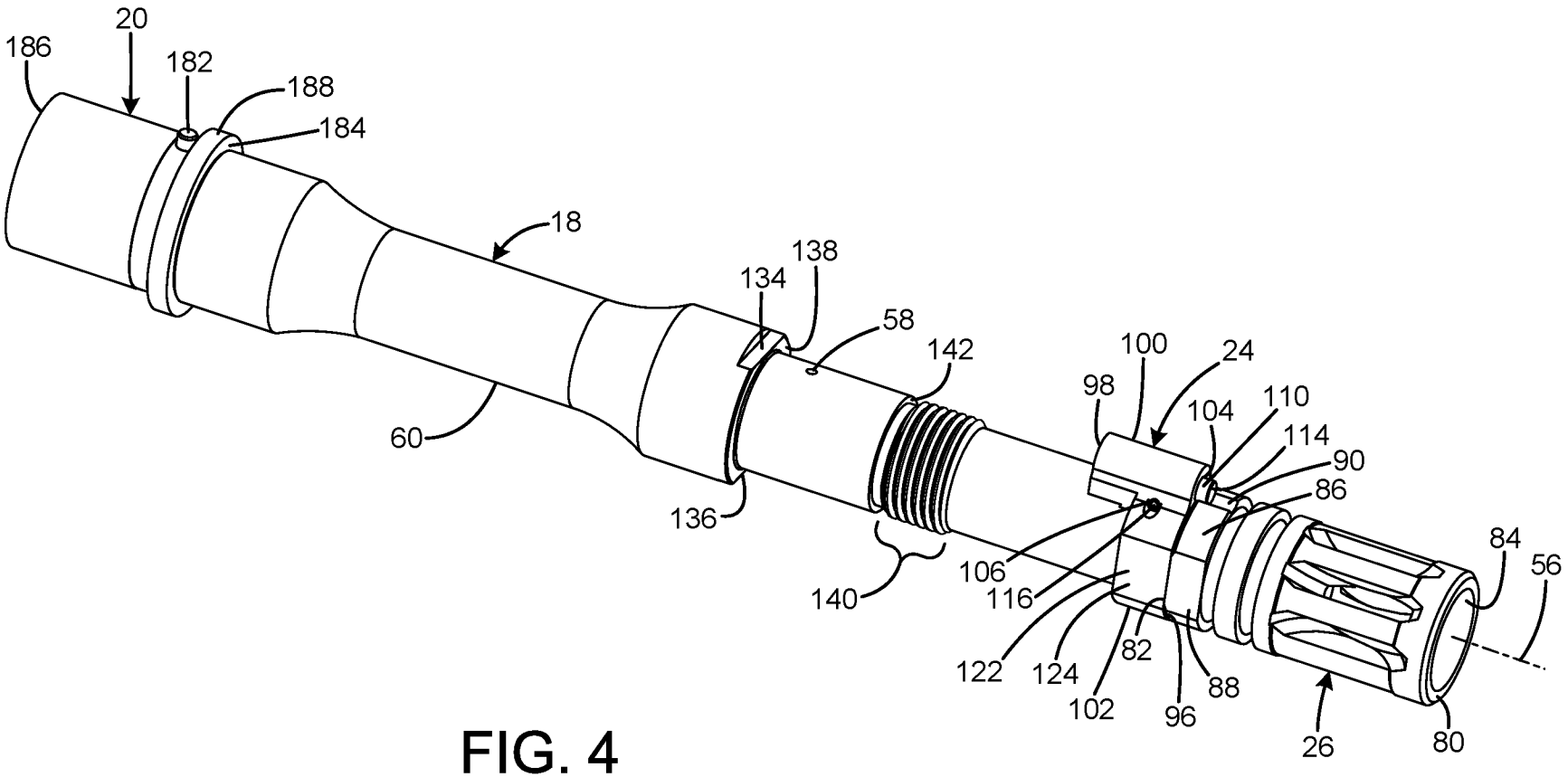
FIG. 4 is a front isometric view of the current embodiment of the barrel, orientation element, and muzzle device of FIG. 1.

FIGS. 2-4 illustrate the improved barrel 18, barrel extension 20, orientation element 24, and muzzle device 26 of the present invention. More particularly, the muzzle device defines a central bore 84 and has a rear exterior surface 86. The rear exterior surface defines wrench flats 88. The top of the rear exterior surface defines a groove 90. Although only one groove is shown in the current embodiment, the muzzle device can be equipped with any desired number of additional orientation features to provide additional orientation and/or tension options. The rear of the central bore includes a threaded portion 92 that threadedly engages/mates with a threaded portion 94 on the muzzle 50 of the barrel 18 to releasably secure the muzzle device to the barrel.

The orientation element 24 maintains the muzzle device 26 in a specified orientation. The orientation element has a front 96, rear 98, top 100, and bottom 102. The orientation element is configured to connect to the barrel 18 with the threaded muzzle portion 94 exposed forward of the orientation element. The top of the orientation element defines a piston aperture 104 that is parallel to the barrel axis 56 and a transverse bore 106 that is perpendicular to the barrel axis. The piston aperture receives a spring 108 and a piston/pin 110. The piston has a narrow rear portion 112 that is received by the spring and a wider forward portion 114 that protrudes from the piston aperture under the influence of the spring. Thus, the spring biases the piston in a forward direction. The piston is an elongated, cylindrical body having an axis 156 parallel to the length of the barrel. A pin 116 is inserted into the transverse bore. The pin is received by a pin groove 118 in the underside of the piston to limit the travel of the piston within the piston aperture and to prevent the piston from falling out of the piston aperture. The orientation element defines a smooth central bore 120 below the piston aperture. The exterior surface 122 of the orientation element defines a right flat 124 and a left flat 126. The top rear of the orientation element extends rearwardly beyond the bottom rear of the orientation element and defines a first bore portion configured to closely receive a selected barrel portion (top flat 130) immediately aft of a shoulder surface 132 on the exterior surface 60 of the barrel 18. The underside of the top rear of the orientation element defines a rear-facing step surface 128 that abuts the top flat and shoulder surface on the exterior surface of the barrel to locate the orientation element in a specified orientation. The bottom rear of the orientation element abuts the shoulder surface on the exterior surface of the barrel. The central bore of the orientation element is sized such that the threaded portion 94 of the barrel is received within the central bore of the orientation element, but the central bore is smooth and does not threadedly engage the threaded portion of the barrel. Thus, the central bore of the orientation element includes a forward bore portion having a forward bore portion diameter less than the first bore portion and larger than the diameter of the threaded muzzle portion of the barrel. The forward bore portion has a limited length such that the threaded muzzle portion protrudes from the orientation element. The top flat on the exterior surface of the barrel and the rear-facing step surface on the orientation element result in the barrel including an indexing surface (the top flat), and the orientation element including an index element (the rear-facing step surface) configured to contact the indexing surface to prevent rotation of the orientation element. The top flat and rear-facing step are flat surfaces. The barrel has a non-circular external profile (the top flat) immediately aft of the shoulder surface, and the orientation element defines a mating non-circular profile (the rear-facing step surface).

When the muzzle device 26 is threaded onto the threaded portion 94 of the barrel 18, the user depresses the spring-loaded piston 110 to permit the muzzle device to be tightened against the front 96 of the orientation element 24, thereby compressing the orientation element between the rear 82 of the muzzle device and the top flat 130 and shoulder 132 of the barrel. The user then loosens the muzzle device just enough to align the groove 90 on the rear exterior surface 86 of the muzzle device with the piston aperture 104. Subsequently, the user releases the piston so the spring 108 can urge the forward portion 114 of the piston into engagement with the groove on the muzzle device to prevent further rotation of the muzzle device. Thus, the piston serves as a lock element movable between a release position and an engaged position, and the groove serves as a lock channel adapted to receive the lock element in the engaged position. The groove includes wall portions configured to contact the piston in the engaged position to prevent rotation of the muzzle device. The groove is an elongated channel having a length parallel to the barrel axis 56. The groove has an arcuate cross section such that the groove is configured to closely receive the cylindrical piston. The muzzle device is a cylindrical body defining a device axis 154, and the groove is parallel to the device axis. If the user subsequently depresses the piston to place the piston in the release position, the piston is then clear of the groove on the muzzle device to enable the muzzle device to rotate for removal from the threaded muzzle portion. Because the orientation element is clamped to the barrel in a specified orientation, and engagement of the piston with the groove on the muzzle device ensures the muzzle device is screwed onto the barrel and a specified orientation, the user can be assured the muzzle device is in the specified orientation relative to the barrel and will function properly when the firearm 10 is discharged. Thus, the user does not have to rely upon an imprecise visually determined alignment, which could result in muzzle device malfunctions. Furthermore, no single-use parts are used to attach or align the muzzle device, so the muzzle device can be easily removed and replaced as desired by depressing the spring-loaded pin to disengage the front portion of the pin from the groove on the muzzle device and unscrewing the muzzle device from the threaded portion of the barrel. In the current embodiment, the muzzle device has only a single groove such that the muzzle device may be locked in only one selected orientation with respect to the orientation element. However, different types of muzzle devices can include more than one groove/lock channel. It should be appreciated that the orientation element and the alignment features on the barrel that engage the orientation element are suitable for use with a wide variety of muzzle devices having the necessary orientation feature or features, including flash hiders/cages/enhancers, door breachers/barrel impact devices, thread protectors/caps/covers, compensators/muzzle brakes/blast diverters/vent brakes/directional mitigation devices, suppressors/silencers/low signature devices, grenade mounts/bigots/igniters/launchers, and mounts for bayonets and other bladed accessories. In addition, the orientation device can be used with any firearm barrel and muzzle device having the necessary alignment features, including the AR-15/10, M16/M4, and any other suitable firearm platforms.

Figure 5:
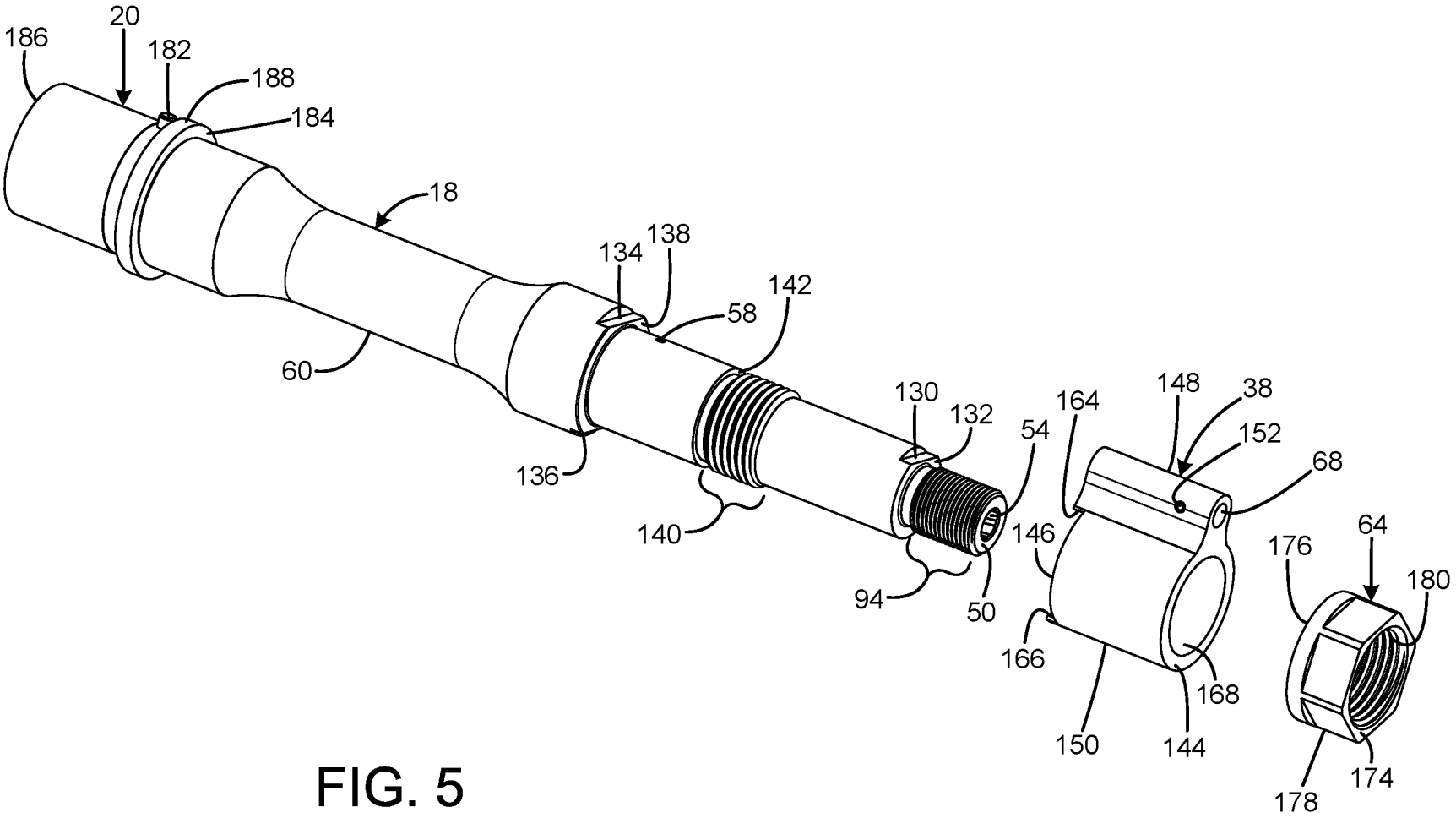
FIG. 5 is an exploded view of the current embodiment of the barrel, gas block, and gas block nut of FIG. 1.
Figure 6:
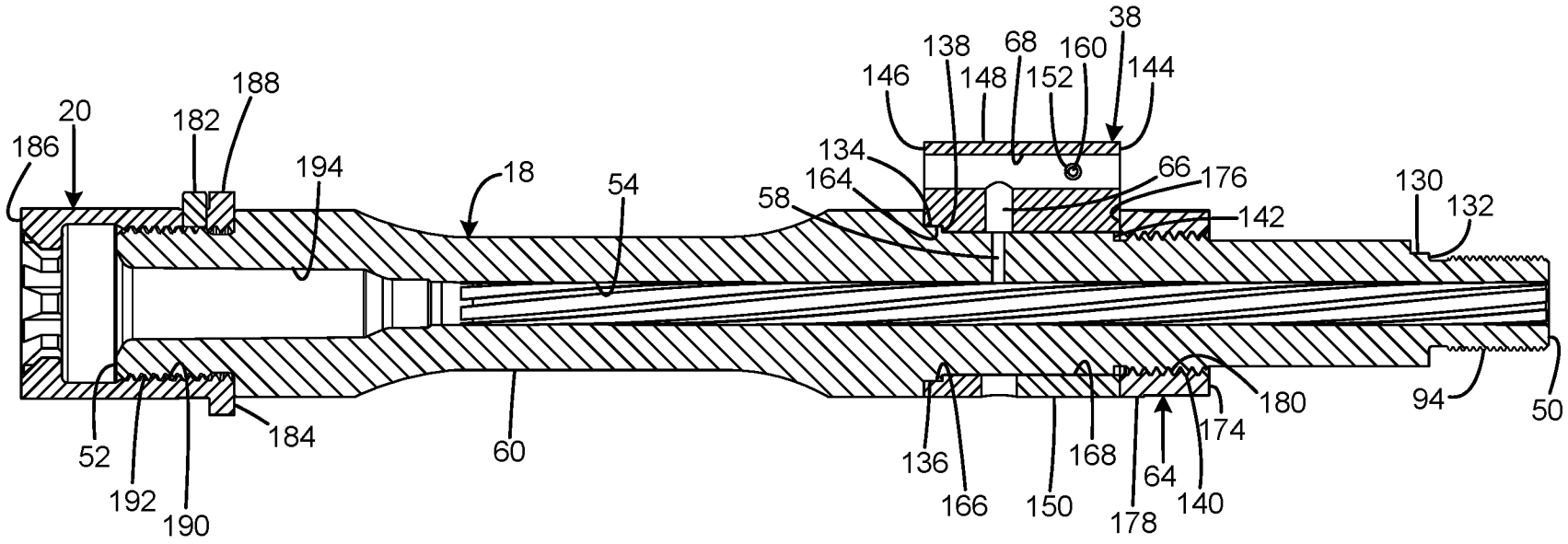
FIG. 6 is a side sectional view of the current embodiment of the barrel, gas block, and gas block nut of FIG. 1.
Figure 7:
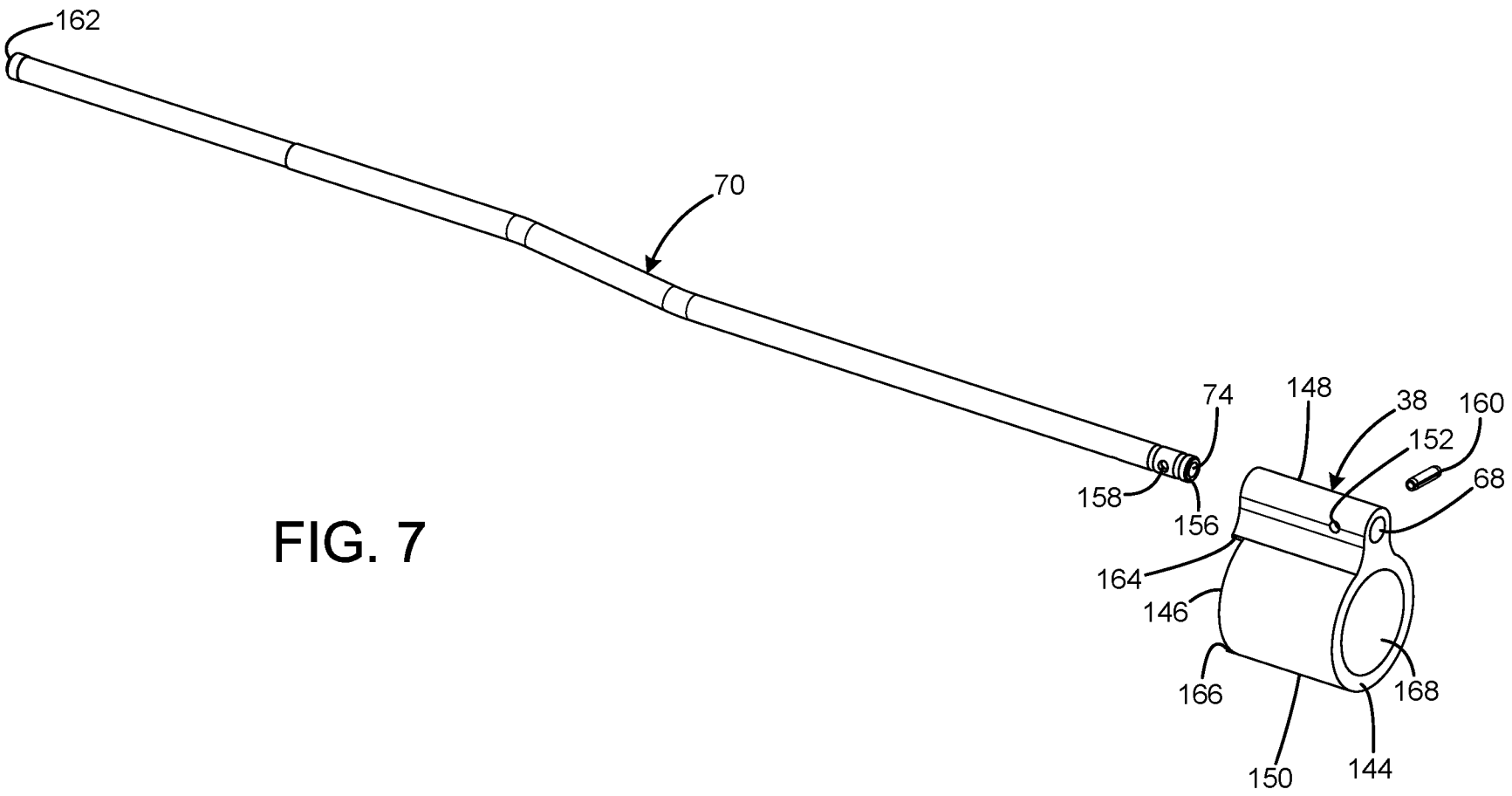
FIG. 7 is an exploded view of the current embodiment of the gas tube and gas block of FIG. 1.

FIGS. 5 and 6 illustrate the improved barrel 18, gas block 38, and gas block nut 64 of the present invention. FIG. 7 illustrates the improved gas block and gas tube 70 of the present invention. More particularly, the exterior surface 60 of the barrel has a top flat 134, bottom flat 136, and shoulder 138 on a middle portion and includes a threaded portion 140 and a shoulder 142 forward of shoulder 138. The gas port 58 is located between the shoulders. The gas block 38 has a front 144, rear 146, top 148, and bottom 150. The top defines the gas tube bore 68, which is parallel to the barrel axis 56 and a transverse bore 152 that is perpendicular to the barrel axis and communicates with the gas tube bore. The gas tube 70 has a front 156 that is received within the gas tube bore. The gas tube defines a transverse bore 158 that is perpendicular to the barrel axis and communicates with the central bore. A gas tube pin 160 is inserted through the transverse bore in the gas block and the transverse bore in the gas tube to pin the front of the gas tube within the gas tube bore. The rear 162 of the gas tube is received within a gas tube aperture 172 in the front 28 of the upper receiver 12. The rear of the gas block defines a top step 164 and a bottom step 166. The bottom of the gas block defines a smooth central bore 168 that is sized to receive the exterior surface of the barrel when the muzzle 50 is inserted into the smooth central bore. The gas block can be slid rearwardly over the threaded portion 140 and shoulder 142 until the top step and bottom step abut the top flat and bottom flat on the exterior surface of the barrel. When top step and bottom step abut the top flat and bottom flat, the gas block is fixed in a specified orientation where the gas passage 66 is axially registered with the gas port 58 and the top of the gas block is centered within an upper channel 170 of the hand guard 16.

The gas block 38 is releasably secured with the top step 164 and bottom step 166 abutting the top flat 134 and bottom flat 136 on the exterior surface 60 of the barrel 18 by the gas block nut 64. The gas block nut has a front 174, rear 176, and exterior surface 178. The exterior surface defines a plurality of wrench flats. The gas block nut has a threaded central bore 180 that is sized to threadedly engaged with the threaded portion 140 on the exterior surface of the barrel. The gas block nut is tightened to clamp the gas block 38 between the rear of the gas block nut and the top flat, bottom flat, and shoulder 138 on the exterior surface of the barrel.

It should be appreciated that the top flat 134 and bottom flat 136 are symmetrically parallel to one another and perpendicular to the gas port 58 and barrel pin 182. Because the barrel pin is solely responsible for upper receiver 12 and barrel 18 alignment, it is imperative that all subsequent orientations be in direct relationship to this critical position. The barrel pin secures the barrel extension 20 onto the rear 52 of the barrel. The barrel extension has a front 184 and rear 186. The front includes an exterior flange 188 and defines a threaded central bore 190 that threadedly engages a threaded portion 192 on the rear of the barrel that encircles a portion of the chamber 194. Furthermore, the gas block nut 64 greater captivation force and ease of installation and/or removal than that afforded by the application of prior art gas block set screws or the tapered pins employed in the original MTh-SPEC front sight base design. Furthermore, the inherent design of the gas block nut prevents the concentricity distorting nature of laterally bias set screw pressures, ensuring better control and integrity of the direct gas impingement system cycle.

Figure 8:
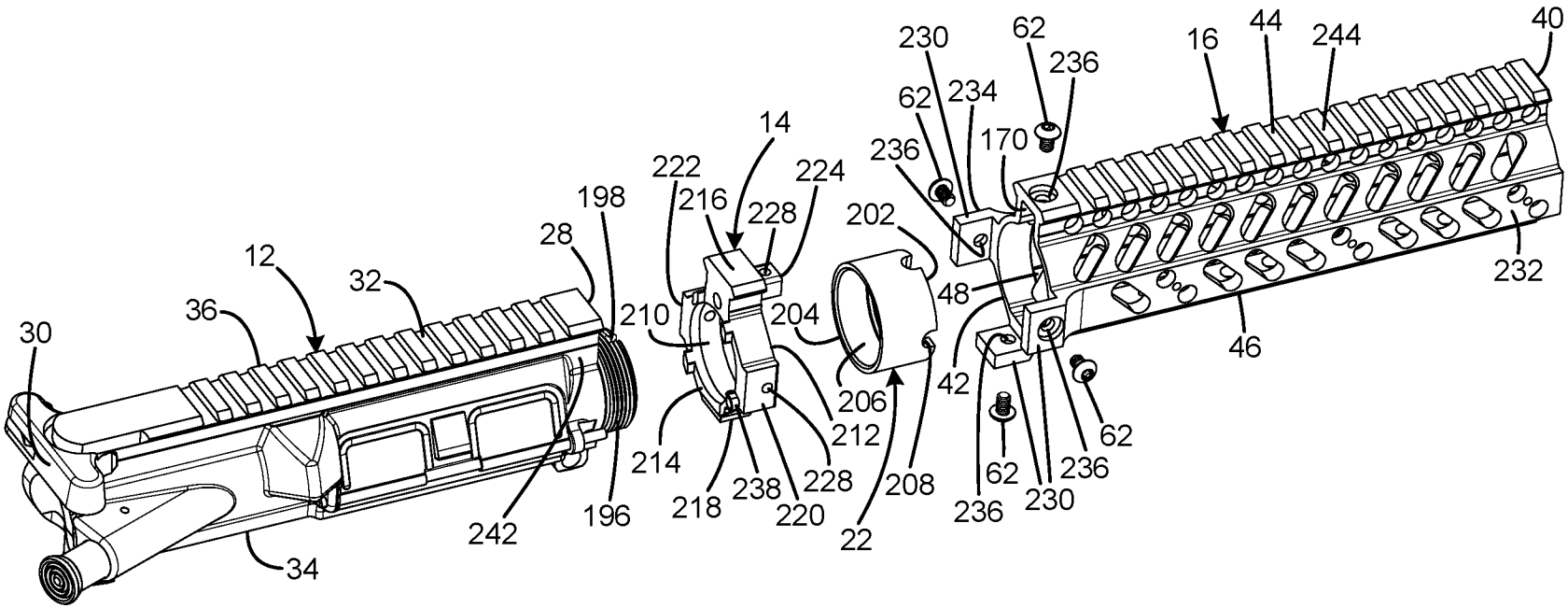
FIG. 8 is a rear exploded view of the current embodiment of the upper receiver, base coupling, barrel nut, and handguard of FIG. 1.
Figure 9:
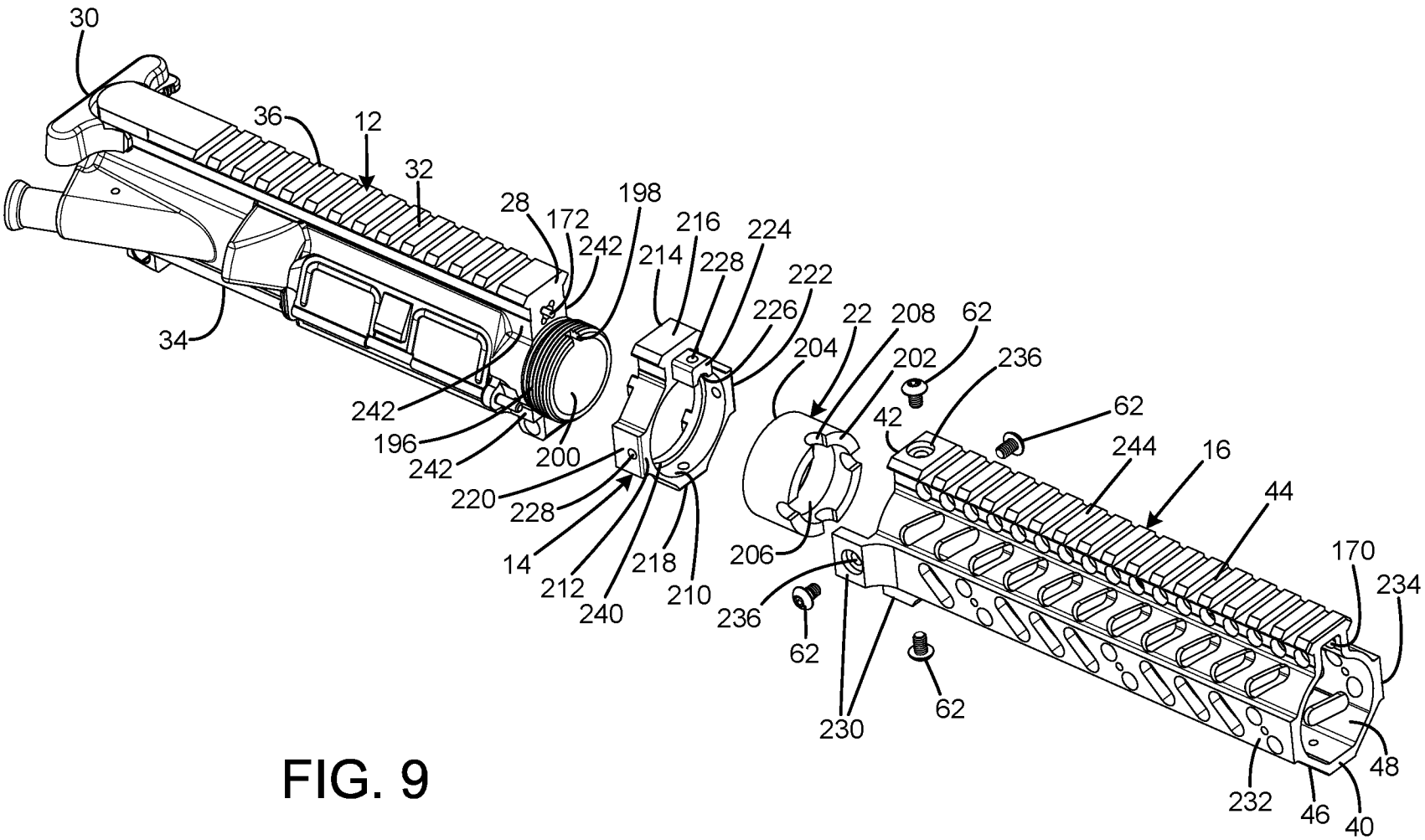
FIG. 9 is a front exploded view of the current embodiment of the upper receiver, base coupling, barrel nut, and handguard of FIG. 1.

FIGS. 8 and 9 illustrate the improved upper receiver 12, base coupling 14, barrel nut 22, and handguard 16 of the present invention. More particularly, the front 28 of the upper receiver includes a threaded extension 196. The top front of the threaded extension defines a barrel pin notch 198 and a central bore 200. The barrel pin notch receives the barrel pin 182 when the rear 186 of the barrel extension 20 is received in the central bore. The barrel nut 22 releasably secures the barrel extension to the upper receiver. The barrel nut has a front 202, rear 204, and defines a threaded central bore 206. The threaded central bore is sized to threadedly engage the threaded extension on the front of the upper receiver. The front of the barrel nut defines four tool engagement recesses 208 that enable the barrel nut to be securely tightened. The base coupling 14 defines a smooth central bore 210 that is sized to receive the barrel nut until the barrel nut contacts shoulder 240. As a result, the shoulder of the base coupling is compressed between the rear of the barrel nut and the front of the upper receiver. The base coupling also has a front 212, rear 214, top 216, bottom 218, right side 220, and left side 222. The top forms a portion of a Picatinny rail and includes a forwardly extending boss 224. The underside of the boss defines a groove 226 that receives a portion of the gas tube 70 to support and align the gas tube. The boss and the bottom, right, and left sides of the base coupling define threaded screw holes 228 that each receive the threaded ends of screws 62.

The boss 224 is sized to be received within the rear 42 of the upper channel 170 of the handguard 16. The rear of the handguard includes bosses 230 extending rearwardly from the right side 232, left side 234, and bottom 46. Each of the bosses 230 and the top 44 rear of the handguard defines a screw hole 236 that receives the cap ends of screws 62. Thus, the rear of the handguard can be attached to the base coupling by axially registering the screw holes 236 with the screw holes 228 and tightening the screws therein. The central bore 48 and upper channel of the handguard are sized to receive the barrel 18 and gas block 38 without contacting either of them. The absence of contact enables the barrel to be free-floating within the handguard to impart the perceived accuracy advantages of a free-floating barrel to the firearm 10. Four alignment posts 238 extending rearwardly from the rear of the base coupling. The alignment posts precisely and repeatedly position the base coupling on the upper receiver by contacting surfaces 242 on the front of the upper receiver, which in turn precisely and repeatedly positions the handguard with respect to the upper receiver. Thus, any accessories attached to the Picatinny rail 62 on the handguard are precisely and repeatably located with respect to the barrel axis 56 even if the handguard has been detached and reattached, which eliminates the need for recalibrating or zeroing the accessories every time the handguard is reinstalled. The position of the base coupling 14 is undisturbed by removal and installation of the handguard because the base coupling is secured in alignment to the upper receiver by the barrel nut 22 and the alignment posts.

The screw holes 228 and 236 are located at the 12:00, 3:00, 6:00, and 9:00 positions and are perpendicular to the barrel axis 56. The positions of the screw holes facilitate access to the cap ends of screws 62 and enable a tool engaged with the cap ends of the screws to rotate 360°. This arrangement makes it much easier and faster to tighten and loosen the screws compared to an arrangement where an engaged tool has much more limited rotation because of obstructions.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm. It should also be appreciated the firearm of the present invention can be supplied in a variety of configurations depending upon the user's needs. The barrel can be manufactured with just the alignment features for use with the orientation element, just the alignment and securing features for use with the gas block and gas block nut, or the alignment and securing features for use with the orientation element, gas block, and gas block nut combined. The base coupling, barrel nut, and handguard described can also be used independently, in combination with just the orientation element and muzzle device, in combination with just the gas block and gas nut, or with orientation element, muzzle device, gas block, and gas nut combined.

While a current embodiment of a firearm has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A muzzle device assembly for a firearm with a barrel defining a barrel axis and having a threaded muzzle portion forward of a shoulder surface at a forward free end of the barrel, the assembly comprising:

an alignment element defining a bore configured to receive a rear portion of the threaded muzzle portion and configured to connect to the barrel with a forward portion of the threaded muzzle portion extending forward of the alignment element and with the threaded muzzle portion exposed forward of the alignment element;

the alignment element having a lock element movable between a release position and an engaged position;

a muzzle device having internal threads configured to mate with the threaded portion of the barrel;

the muzzle device defining a lock channel adapted to receive the lock element in the engaged position;

the lock channel including wall portions configured to contact the lock element in the engaged position to prevent rotation of the muzzle device; and the lock element in the release position being clear of the lock channel to enable the muzzle device to rotate for removal from the threaded muzzle portion.

2. The muzzle device assembly of claim 1 wherein the alignment element defines a first bore portion configured to closely receive a selected barrel portion immediately aft of the shoulder surface.

3. The muzzle device assembly of claim 2 wherein the alignment element includes a forward bore portion having a forward bore portion diameter less than the first bore portion and larger than the diameter of the threaded muzzle portion of the barrel.

4. The muzzle device assembly of claim 3 including a rear-facing step surface configured to abut the shoulder surface.

5. The muzzle device assembly of claim 4 wherein the forward bore portion has a limited length such that the threaded muzzle portion protrudes from the alignment element.

6. The muzzle device assembly of claim 1 wherein the barrel includes an indexing surface, and the alignment element includes an index element configured to contact the indexing surface to prevent rotation of the alignment element.

7. The muzzle device assembly of claim 6 wherein the indexing surface and the alignment element are flat surfaces.

8. The muzzle device assembly of claim 1 wherein the lock element is a pin.

9. The muzzle device assembly of claim 1 wherein the lock element is spring biased in a forward direction.

10. The muzzle device assembly of claim 1 wherein the lock element is an elongated body having an axis parallel to the length of the barrel.

11. The muzzle device assembly of claim 1 wherein the lock element is a cylindrical body.

12. The muzzle device assembly of claim 1 wherein the lock channel is an elongated channel having a length parallel to the axis of the barrel.

13. The muzzle device assembly of claim 1 wherein the lock channel has an arcuate cross section such that the lock channel is configured to closely receive a cylindrical lock element.

14. The muzzle device assembly of claim 1 wherein the muzzle device is a cylindrical body defining a device axis, and the lock channel is parallel to the device axis.

15. The muzzle device assembly of claim 1 wherein the muzzle device has only a single lock channel such that it may be locked in only one selected orientation with respect to the alignment element.

16. The muzzle device assembly of claim 1 wherein the barrel has a non-circular external profile immediately aft of the shoulder surface, and the alignment element defines a mating non-circular profile.

17. The muzzle device assembly of claim 16 wherein the non-circular external profile includes a flat.

18. The muzzle device assembly of claim 1 wherein the bore is unthreaded.

19. The muzzle device assembly of claim 1 wherein the bore closely receives the threaded muzzle portion.

20. The muzzle device assembly of claim 1 wherein a rear surface of the alignment element faces the barrel shoulder surface.

* * * * *